US011371655B2

(12) United States Patent
Ball

(10) Patent No.: US 11,371,655 B2
(45) Date of Patent: Jun. 28, 2022

(54) CRYOGENIC FLUID VAPORIZER

(71) Applicant: Graham Ball, Lynbrook (AU)

(72) Inventor: Graham Ball, Lynbrook (AU)

(73) Assignee: Taylor-Wharton Malaysia Sdn. Bhd., Shah Alam (MY)

( * ) Notice: Subject to any disclaimer, the term of this patent is extended or adjusted under 35 U.S.C. 154(b) by 317 days.

(21) Appl. No.: 16/192,543

(22) Filed: Nov. 15, 2018

(65) Prior Publication Data

US 2019/0154201 A1 May 23, 2019

(30) Foreign Application Priority Data

Nov. 15, 2017 (AU) ..... 2017904622

(51) Int. Cl.
*F17C 9/02* (2006.01)
*F28F 1/40* (2006.01)
*F28D 21/00* (2006.01)

(52) U.S. Cl.
CPC ..... *F17C 9/02* (2013.01); *F28F 1/40* (2013.01); *F17C 2205/0352* (2013.01); *F17C 2223/0161* (2013.01); *F17C 2225/0123* (2013.01); *F17C 2227/0393* (2013.01); *F17C 2227/0397* (2013.01); *F28D 2021/0033* (2013.01)

(58) Field of Classification Search
CPC ..... F17C 9/02; F17C 2205/0352; F17C 2223/0161; F17C 225/0393; F17C 2227/0397; F28D 7/10; F28D 1/40; F28D 2021/0033
See application file for complete search history.

(56) References Cited

U.S. PATENT DOCUMENTS

| | | | |
|---|---|---|---|
| 3,672,446 | A | 6/1972 | Tibbetts et al. |
| 4,399,660 | A | 8/1983 | Vogler, Jr. et al. |
| 4,479,359 | A | 10/1984 | Pelloux-Gervais |
| 4,487,256 | A | 12/1984 | Lutjens et al. |
| 4,643,250 | A | 2/1987 | Niggemann et al. |
| 4,819,454 | A | 4/1989 | Brigham et al. |

(Continued)

FOREIGN PATENT DOCUMENTS

| | | | |
|---|---|---|---|
| EP | 0035444 | A1 | 9/1981 |
| EP | 0450906 | A1 | 10/1991 |

(Continued)

OTHER PUBLICATIONS

Baudouy, "Heat Transfer and Cooling Techniques at Low Temperature," 24 pages (2015).

(Continued)

*Primary Examiner* — Elizabeth J Martin
(74) *Attorney, Agent, or Firm* — Merchant & Gould P.C.

(57) ABSTRACT

A liquid cryogenic vaporizer and method of use are disclosed. The vaporizer includes a main tube, a cryogenic fluid inlet positioned proximate a first end of the main tube for receiving cryogenic fluid, and a second tube having a diameter smaller than the main tube, the second tube being in fluid communication with the main tube at a second end of the main tube opposite the cryogenic fluid inlet. The vaporizer further includes an outlet extending from the inner tube for expelling vaporized fluid. The second tube can be positioned within the main tube, and one or more velocity limiters are optionally included within the main tube along a fluid path.

14 Claims, 15 Drawing Sheets

(56) References Cited

U.S. PATENT DOCUMENTS

| | | | | |
|---|---|---|---|---|
| 5,163,303 | A * | 11/1992 | Miyata | F17C 9/02 62/50.2 |
| 5,174,371 | A | 12/1992 | Grillo | |
| 5,251,452 | A | 10/1993 | Wieder | |
| 5,390,500 | A | 2/1995 | White et al. | |
| 5,473,905 | A | 12/1995 | Billman | |
| 5,561,983 | A * | 10/1996 | Remes | F17C 9/02 62/48.1 |
| 5,937,656 | A | 8/1999 | Cheng et al. | |
| 7,475,553 | B2 | 1/2009 | Brown | |
| 7,493,772 | B1 | 2/2009 | Brown | |
| 7,870,747 | B1 | 1/2011 | Brown | |
| 8,069,678 | B1 | 12/2011 | Bernert | |
| 8,402,774 | B2 | 3/2013 | Brown | |
| 8,662,149 | B1 | 3/2014 | Bernert, Jr. et al. | |
| 8,776,535 | B1 | 7/2014 | Bernert, Jr. et al. | |
| 9,109,795 | B2 | 8/2015 | Peyron | |
| 2007/0022760 | A1 | 2/2007 | Billman | |

FOREIGN PATENT DOCUMENTS

| | | | |
|---|---|---|---|
| EP | 2063208 | A2 | 5/2009 |
| FR | 2525759 | A1 | 10/1983 |
| GB | 1321728 | | 6/1973 |
| GB | 1416106 | | 12/1975 |
| JP | 3907368 | B2 | 4/2007 |
| KR | 10-1609671 | B1 | 4/2016 |
| WO | 2014113498 | A1 | 7/2014 |

OTHER PUBLICATIONS

Installation, Operation & Maintenance Manual for Sentry Tube-in-Tube DTC Series Heat Exchangers, 12 pages (Copyright 2016).

International Search Report and Written Opinion for Application No. PCT/IB2018/001442 dated Mar. 18, 2019.

Extended EP search report and preliminary opinion, dated Jul. 21, 2021, for European patent application No. EP 18879853.2 (8 pgs.).

* cited by examiner

CRYOGENIC FLUID VAPORIZER

CROSS-REFERENCE TO RELATED APPLICATIONS

This application claims priority from Australian Patent Application No. 2017904622 filed on Nov. 15, 2017. The entire content of the priority application is incorporated herein by reference.

FIELD OF THE INVENTION

This invention relates to a liquid cryogenic vaporizer and a method of vaporizing a cryogenic liquid, in particular a cryogenic liquefied gas.

BACKGROUND OF THE INVENTION

The design of current ambient cryogenic vaporizers has not changed substantially over the last 50 years. An enormous amount of energy is required to separate gases from their normal atmosphere and then liquefy those gases. The liquefied gas is then stored in super insulated tanks in order to prevent this energy from escaping. Current conventional vaporizers typically consist of finned tubes and in some cases tubes with no fins. Nearly always, these are approximately 25 mm in diameter and are connected in series to make a longer length of tube in which the internal diameter of the entire passage from one end to the other does not change. Multiple parallel passes of the same design allow for the increase in the capacity. Thus the design of a single pass is also the design of all parallel passes.

The vaporizers mentioned above have certain disadvantages. As liquid turns to vapor along the length of the vaporizer, the quality of the vapor changes from 0% where it is all liquid to 100% where the fluid is all vapor. As the densities of the two phases differ greatly, the velocity of the t-phase mixture increases dramatically along the direction of flow. At the entry end, velocity is low and heat transfer occurs to mostly pure liquid. Vapor forms from boiling liquid at the wall of the tubes. At temperature differences exceeding a critical value, the vapor "blankets" the warmer wall from the cooler fluid, which is a phenomenon known as the Leidenfrost Effect or gun barrel effect. This then lowers the heat transfer co-efficient (HTC) and in some cases by orders of magnitude. This effect is akin to placing droplets of water into a hot frying pan where it floats around the pan on a thin film of vapor and does not boil or evaporate. This is the effect that appears within the tubes of conventional vaporizers. Slugging also occurs, where not all the liquid is converted into a gas.

The above effect is augmented by the increasing velocity of the two-phase flow. Considering two-phase flow without heat transfer for the moment, at high enough velocities, the vapor phase makes its own passage along the core through the middle of the tube and, on the outside of this, there is an annular liquid phase. When heat transfer is added to this effect, the Leidenfrost Effect will exist as well as annular flow which effectively provides three zones. The first zone starts at the wall of the tube where there is a ring of vapor forming a blanket as described above. There is then a liquid phase in annulus form and within that a vapor core. Overall the heat transfer efficiency of the vaporizer is well below ideal.

Excessive velocities increase frictional losses and therefore increase pressure drop which is another disadvantage of conventional vaporizers. Rapid boiling of the liquid at the entry to a vaporizer, when temperature differentials are at around 200° C., causes surging in many instances and this can cause many problems with downstream instrumentation.

The most common material used for ambient vaporizers is aluminum, as it is relatively cheap compared with other materials and has excellent heat transfer properties. The reason most aluminum extrusions are kept to small bores is because of the limitations of the extruding equipment of the aluminum suppliers. Furthermore, the larger the internal diameter becomes, the thicker the wall thickness needs to be in order to retain pressure. This situation has not changed for up to 50 years.

Conventional vaporizers are also very labor intensive to manufacture as they are big, cumbersome, and difficult to build. Some heat exchangers or vaporizers include very tall stacks of tubes or pipes that have reduced or ineffective resistance to wind and the outside elements. Furthermore, the movement of the giant stacks of tubes leads to cracking of the tubes.

The present invention seeks to overcome any one or more of the above disadvantages by providing a system and process that allows energy transfer in a simple and cost effective way which saves on raw material cost, by up to 45%, in order to build heat exchangers or vaporizers. The present invention takes advantage of the stored energy within the cryogenic liquid.

SUMMARY OF THE INVENTION

According to a first aspect of the invention, there is provided a liquid cryogenic vaporizer including a main tube, a cryogenic fluid inlet positioned proximate a first end of the main tube for receiving cryogenic fluid, and a second tube having a diameter smaller than the main tube, the second tube being in fluid communication with the main tube at a second end of the main tube opposite the cryogenic fluid inlet. The vaporizer also includes an outlet extending from the inner tube for expelling vaporized fluid.

In certain aspects, the vaporizer includes one or more surfaces within the main tube; and at least one velocity limiter positioned within the main tube along a fluid path between the cryogenic fluid inlet and the cryogenic fluid outlet, the at least one velocity limiter including one or more surfaces arranged to limit velocity of fluid flowing within the main tube, the velocity limiter controlling an amount of heat transfer between the fluid and the one or more surfaces within the main tube.

In still further aspects, the second tube is positioned within the main tube. The vaporizer can include a heat exchange unit fluidically connected to the outlet. The heat exchange unit can include a counterflow tube-in-tube heat exchanger and a second heat exchanger having an inlet connected to the outlet and an outlet tube forming a gas feedback path to the counterflow tube-in-tube heat exchanger.

According to a further aspect, there is provided a liquid cryogenic vaporizer including a main tube; an inlet to the main tube for receiving cryogenic liquid; and an outlet from the main tube for expelling vaporized liquid. The velocity of the flow of the liquid in the main tube is controlled to increase heat transfer between the liquid and one or more surfaces within the main tube.

Preferably the main tube is dimensioned to reduce said velocity of the flow of the liquid. The vaporizer may further include one or more inner tubes located within the main tube such that a space is formed between an inner surface of the main tube and an outer surface of said one or more inner tubes. The one or more inner tubes may have said inlet to receive said cryogenic liquid to flow in said one or more inner tubes.

Preferably the liquid is vaporized upon leaving an outlet to said one or more inner tubes, said expelled vaporized liquid is expelled within the main tube and acts as the heat transfer to the liquid remaining in said one or more inner tubes, the expelled vaporized liquid eventually being expelled from said main tube.

According to a still further aspect of the invention, there is provided a liquid cryogenic vaporizer including a main tube; an inlet to the main tube for receiving cryogenic liquid; and an outlet from the main tube for expelling vaporized liquid. The main tube is dimensioned to reduce the velocity of the flow of the liquid through the main tube in order to increase heat transfer between the liquid and the inner surface of the main tube.

The vaporizer may also include an inner tube located within the main tube, such that a space is formed between the outside surface of the inner tube and the inner surface of the main tube. The inner tube can have a first end for receiving the fluid and said outlet is at a second end of the inner tube. Preferably the liquid flows from said inlet to said outlet. The liquid may flow from said inlet, through said space to the first end of the inner tube, through the inner tube to be expelled at said outlet.

The vaporizer preferably further includes one or more plates located at predefined locations in said main tube, said one or more plates having at least one aperture for the fluid to flow through, said one or more plates acting to create turbulence to mix a vapor phase of the liquid and the liquid together to assist in making the liquid contact the inner surface of the main tube. The vaporizer may further include a fluid controller means or fluid motion generator located in said main tube through which the liquid passes, said generator imparting a swirling motion to the fluid such that the liquid contacts the inner surface of the main tube in order to further increase the heat transfer between the liquid and the inner surface of the main tube. The fluid motion generator may have a base or disc and at least one upstanding curved portion. Examples of fluid controller means may include a control valve, an orifice having one or more apertures, a pitot tube, a flow nozzle, a venturi meter, an elbow tap, a wedge meter, or an averaging pitot. A fluid controller means may also include a fluid velocity limiter having one or more surfaces arranged to limit the liquid flow velocity within the main tube. The fluid velocity limiter may also control the amount of heat transfer between the fluid and the one or more surfaces within the main tube. There may be one or more fluid control means, fluid velocity limiters, or fluid motion generators.

According to a further aspect of the invention, there is provided a method of vaporizing a cryogenic liquid including providing a main tube having an inlet and an outlet; receiving cryogenic liquid at said inlet to travel through the main tube; expelling vaporized liquid from the outlet; and reducing the velocity of the flow of the liquid through the main tube by predetermined dimensions of the main tube, such that the heat transfer between the liquid and an inner surface of the main tube is increased.

BRIEF DESCRIPTION OF THE DRAWINGS

A preferred embodiment of the invention will hereinafter be described, by way of example only, with reference to the drawings in which.

DETAILED DESCRIPTION OF THE PREFERRED EMBODIMENTS

Figure 1A:
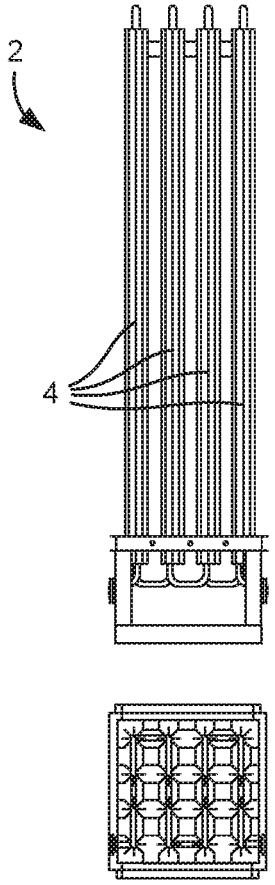
FIG. 1A is a side and plan view of a conventional heat exchanger.
Figure 1B:
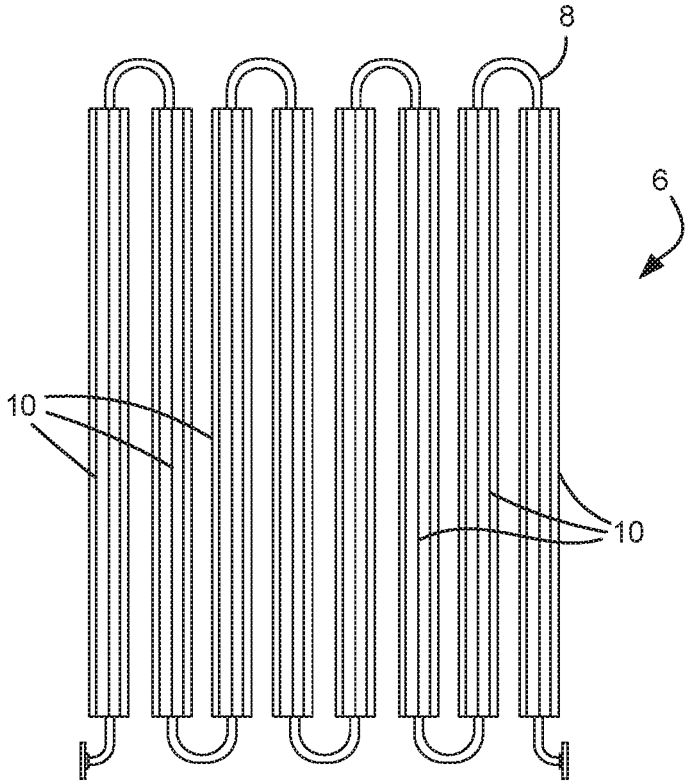
FIG. 1B is a side view of another conventional heat exchanger.

Referring to FIG. 1A, there is shown a conventional heat exchange unit (2) having a series of tube sections (4), with fins, in which fluid flows to either be cooled or heated. A further example of a conventional heat exchanger is shown in FIG. 1B where an exchanger (6) has looped sections (8) joining upright tube sections (10) that are each covered by a series of fins.

Figure 2:
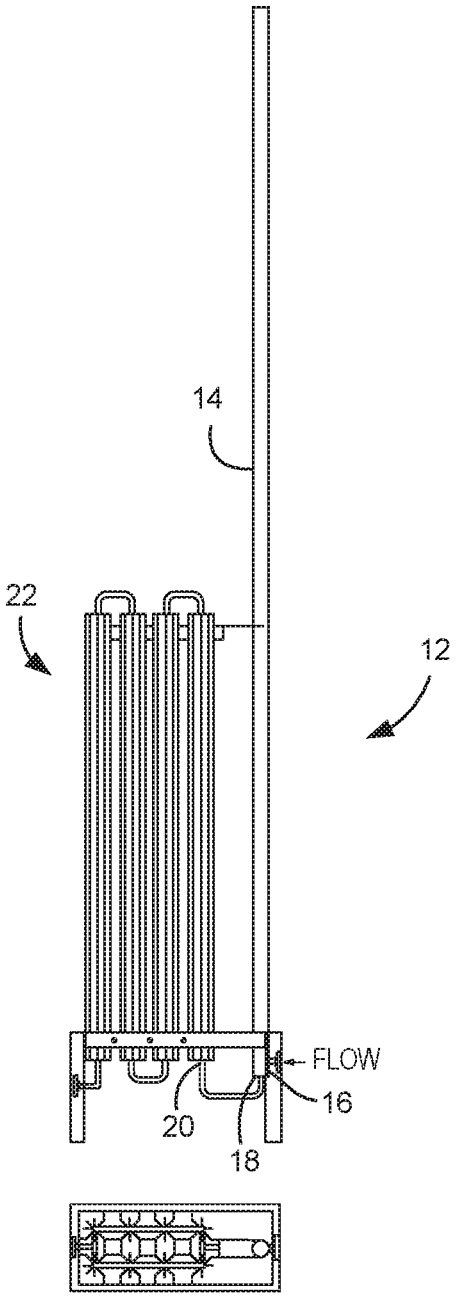
FIG. 2 is a side view and plan view of a cryogenic fluid vaporizer according to an embodiment of the invention.

In FIG. 2, there is shown a first embodiment of the present invention in which a cryogenic fluid vaporizer (12) includes a vaporizer tube (14) of variable length which has an input (16) to receive a super cooled liquid, such as nitrogen, oxygen, argon, carbon dioxide, liquid natural gas (LNG), and many other liquids. The liquid flows through the tube (14) and eventually is output at outlet (18) to a first tube (20) of a heat exchange unit (22). The tube (14) is preferably made from stainless steel and not aluminum, as sometimes it is not desirable to have too much heat transferred to the liquid or liquid/gas flow that can cause the Leidenfrost Effect.

Figure 3:
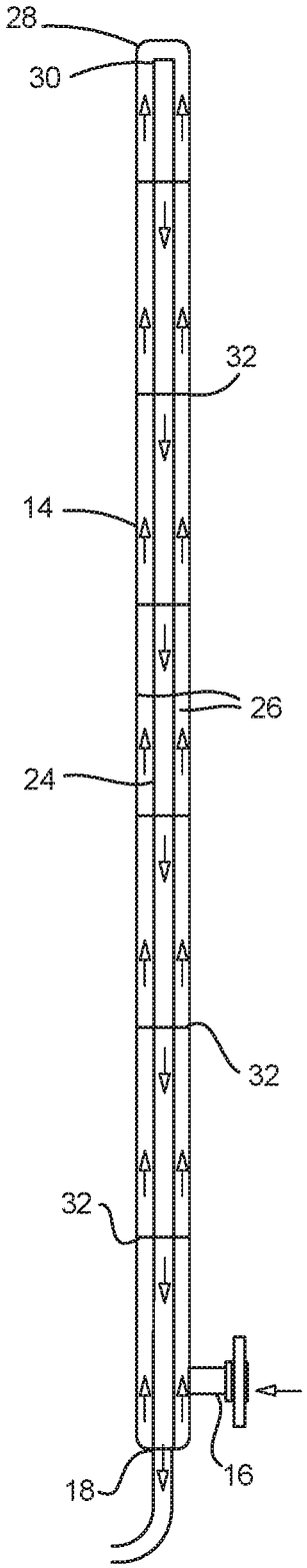
FIG. 3 is a side view of a tube that forms part of the vaporizer and shows the flow of fluid within the tube.

Referring to FIG. 3, the vaporizer tube (14) is preferably cylindrical and has an inner, preferably cylindrical, core tube (24) which is surrounded by a space, such as an annulus (26), that is an open area that extends from the outside surface/wall of the inner tube (24) to the inside surface or inner wall of the vaporizer tube (14). Fluid is input through inlet (16) upwards in the annulus (26) around the core inner tube (24) until it reaches the top (28) of the tube (14). It then enters an inlet (30) at the top of the inner tube (24) and travels downwardly through to the outlet (18) to then travel to the heat exchange unit. On its upward path, a number of plates or baffles (32) are positioned at predefined intervals and surround the inner tube (24). Each of the plates or baffles (32) may have any number of small apertures in which the fluid passes. This is designed to slow down the velocity of the fluid.

Figure 3A:
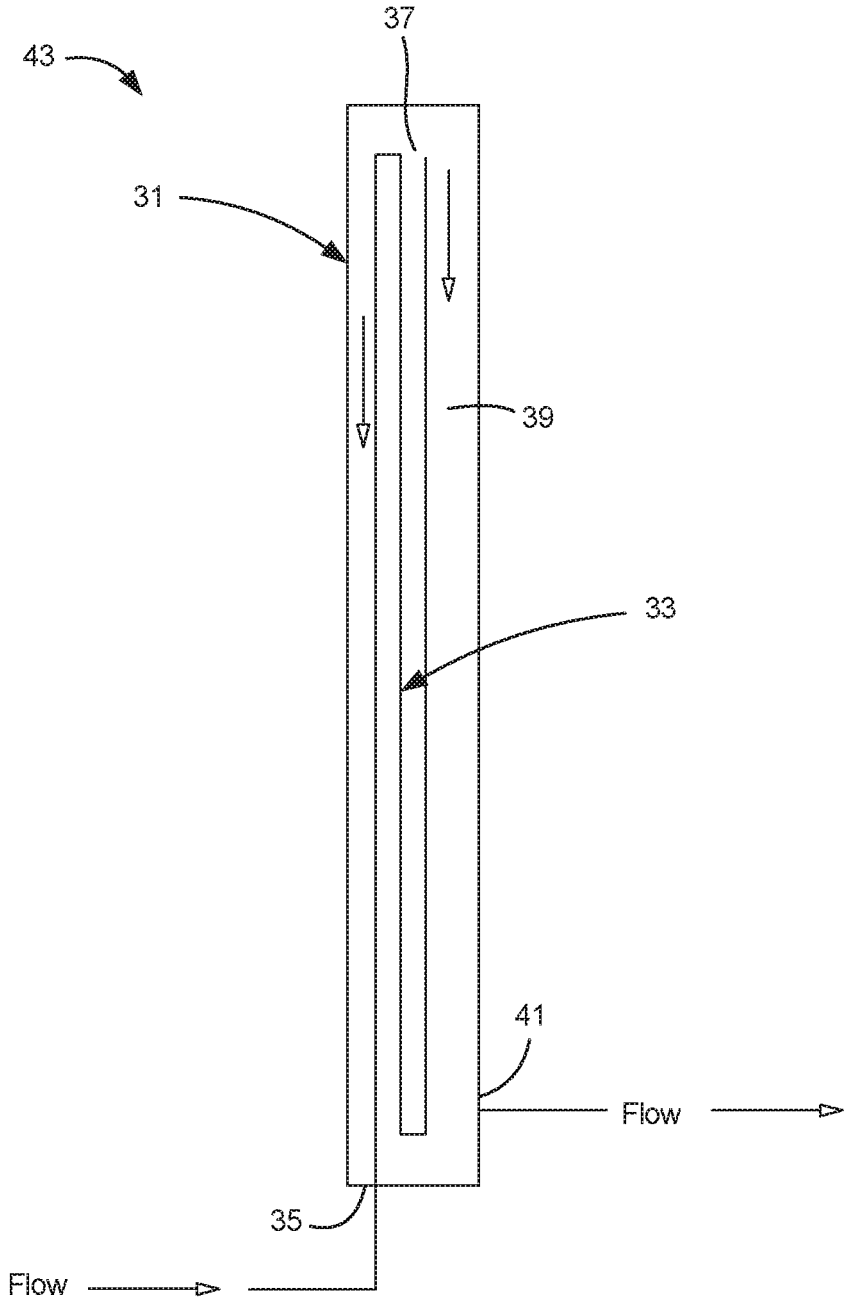
FIG. 3A is a block diagram of a further embodiment of the cryogenic fluid vaporizer.

Referring to FIG. 3A, there is shown a further embodiment of a liquid cryogenic vaporizer 43 which has a main tube 31. Located within the main tube 31 is a series of inner tubes 33 that can be connected to one another or, alternatively, there can be one continuous inner tube 33. The series of tubes or the single tube 33 has an inlet 35 through which cryogenic liquid is input through the whole vaporizer 43. It travels initially upward and then downward and then upward again to exit at outlet 37 to the series of tubes 33. Here, it is in the form of a vaporized liquid or gas which exits the outlet 37 and then flows downwardly as indicated by the arrows in a space 39 of the main tube 31. The gas that flows downwardly within the space 39 contacts the outer surface of the tube or tubes 33 and acts as a heat transfer medium to the liquid that is flowing within those tubes. In this way a more accurate flow system is achieved that offers a precise flow rate of the liquid and precise pressure drop that is experienced within the main tube 31. A number of the tubes and the length of tubes will relate directly to the maximum flow rate capacity of each vaporizer 43. Therefore the number of tubes and the length of the tubes are variable. Eventually, the gas that is expelled from the outlet 37 after travelling downwardly in the space 39 exits at an outlet 41 from the main tube 31 and can be input to a separate heat exchanger or the like.

It may still be beneficial to have the expelled gas exiting from the top of the main tube 31 or shell such that the outlet 37 is co-located with the top of the main tube 31. As with other embodiments, any number of plates or baffles 32 can be positioned at pre-defined intervals in the main tube 31 and/or within the tubes 33.

The loss of efficiency described in the background part of the invention is overcome by redistributing the two-phases, that is gas and liquid, which have segregated from each other as stated above. The tube (14) is generally of a larger diameter to existing conventional heat exchange pipes and this assists in slowing down the velocity and any unhelpful flow characteristics. As mentioned previously, the fluid is slowed down even further with any number of orifice plates or baffles that contain one or more apertures placed in the flow path of the two-phase flow. The large diameter tubing (14) slows down the velocity of the two-phase flow within the initial stage of the vaporizer (12), that is, as it enters inlet (16) and is just about to move upwardly as shown in FIG. 3. At this point the temperature differential is at its greatest, at around 200° C., and there is no requirement for extended surface areas and it is in fact creating the segregated effect stated above. The plates or baffles (32) are distributed along the flow path of the larger tube (14) and create disturbance or turbulence which mixes the vapor and liquid phases together in such a way that it reduces the segregation as described above. The liquid phase will be caused to collide with the inside wall of tube (14) in such a way that it improves the heat transfer co-efficient. The number and spacing of the plates (32) can be optimized to give the best heat transfer co-efficient based on the flow rate and the liquefied gas being vaporized.

The larger diameter tube (14) is generally used without fins or an extended surface area. In the particular case of vaporizing liquid nitrogen, the temperature differential between ambient temperature and the liquid temperature will be in excess of 200° C. This is where free energy is absorbed in order to vaporize the liquid nitrogen.

By including the plates (32), as mentioned previously, it reduces the flow rate and enables better mixing between the two phases. Slugging can take place whereby the liquid is not all converted into gas. It is similar to a champagne bottle opening where it is all bubbles and liquid, with no clear separation of vapor from the liquid. All of the gas needs to be uniformly converted from the liquid phase. The optimum length of the tube (14) is dependent on the flow rate and can be 12 meters or higher, standard sizes are about 6 meters.

Figure 4A:
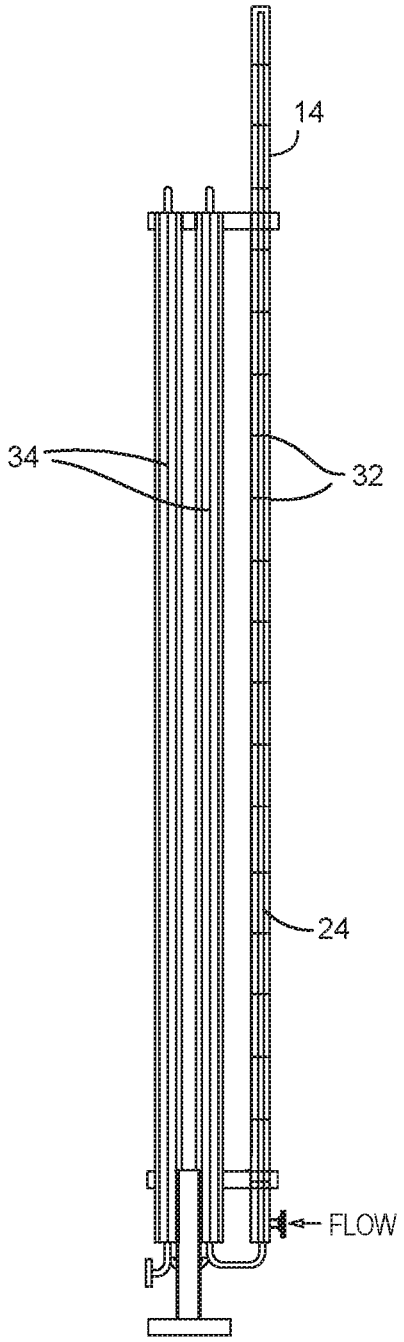
FIG. 4A is a side view of a further embodiment of the vaporizer including a series of plates located within the tube of the vaporizer.
Figure 4C:
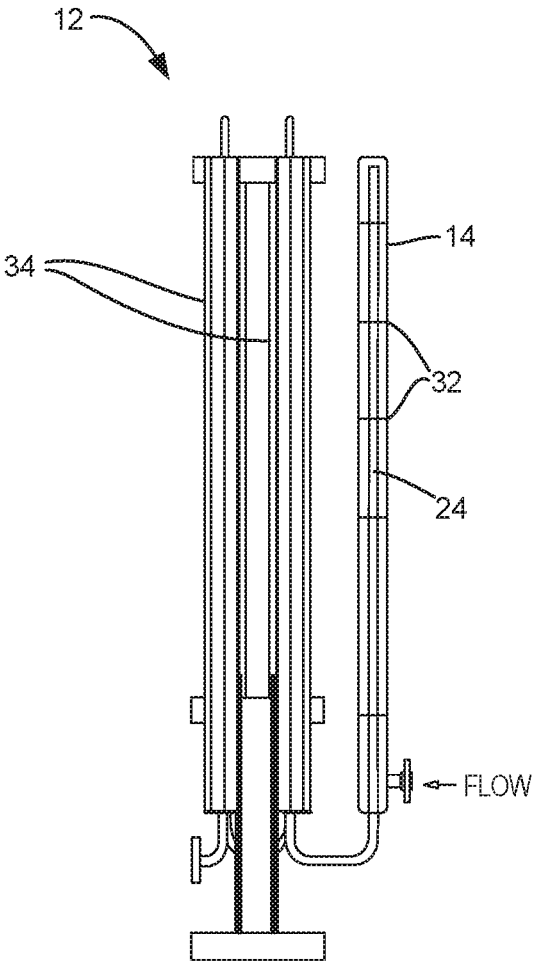
FIG. 4C is a side view of yet a further embodiment of the vaporizer including a series of plates located within the tube of the vaporizer.
Figure 4B:
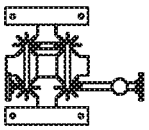
FIG. 4B is a plan view of a further embodiment of the vaporizer including a series of plates located within the tube of the vaporizer.

Referring to FIGS. 4A and 4B, the tube (14) is shown in this example as being of about 6 meters in length. Each of the tubes (34) of the heat exchanger, into which the tube (14) is connected, are of a length of about 5 meters. The outer tube (14) has a cross-sectional area of about 5,384 $mm^2$, an internal diameter of 82.8 mm, and an outside or external diameter of 88.9 mm. The inner or core tube (24) has a length also of 6 meters, a cross-sectional area of 506 mm2, an internal diameter of 23 mm and an external diameter of 25.4 mm. The aluminum finned tubes (34) of the heat exchanger are stainless steel lined tubes and are 1.64 m of surface area per linear meter of tubing, an internal diameter of 23 mm, and overall 20 meters in length, that is 4×5 meters. The plates (32) inside the tube (14) in this example have up to ten holes having a diameter of 7 mm each, with the holes equally spaced around an internal aperture in which the core tube (24) fits and protrudes through. Each plate (32) has a total area of holes which is 384 $mm^2$ and, in this example, there are nineteen internal plates (32). The spacing between each adjacent plate (32) is about 300 mm, however this can be varied.

Figure 4D:
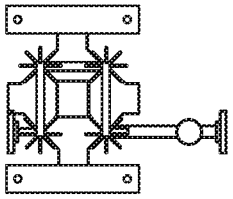
FIG. 4D is a plan view of yet a further embodiment of the vaporizer including a series of plates located within the tube of the vaporizer.

Referring to FIGS. 4C and 4D, there is shown a further example of the vaporizer (12) in which the tube (14) is only 2 meters in total length, being a 2.5 inch pipe having 66.9 mm for its internal diameter and 73 mm external diameter. Its total cross-sectional area is 3,515 $mm^2$. The inner tube or core tube (24) is also 2 meters in length, has a cross-sectional area of 506 mm2, an internal diameter of 23 mm and an external diameter of 25.4 mm. The aluminum tubing (34) of the heat exchanger again is a stainless steel lined tube, having 1.65 m of aluminum external surface area per linear meter of tube and the internal diameter is 23 mm. It is 8 meters in total length, that is four rungs of 2 meters in length each. There are nineteen internal plates (32), each having up to ten holes of 7 mm diameter and a total area (of holes) being 384 $mm^2$ as in FIG. 4A.

Figure 5B:
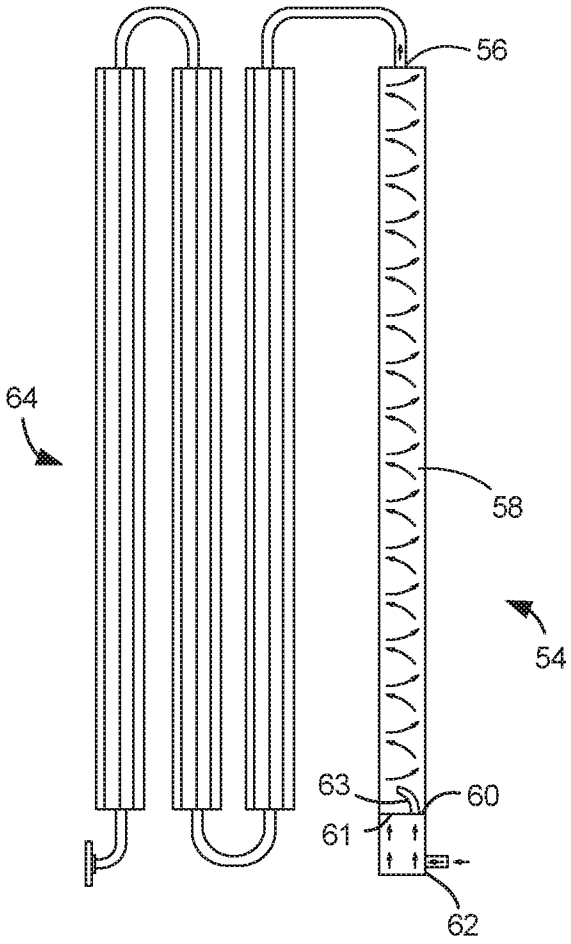
FIG. 5B shows a side view of a further embodiment of the invention which uses the ambient temperature.
Figure 5A:
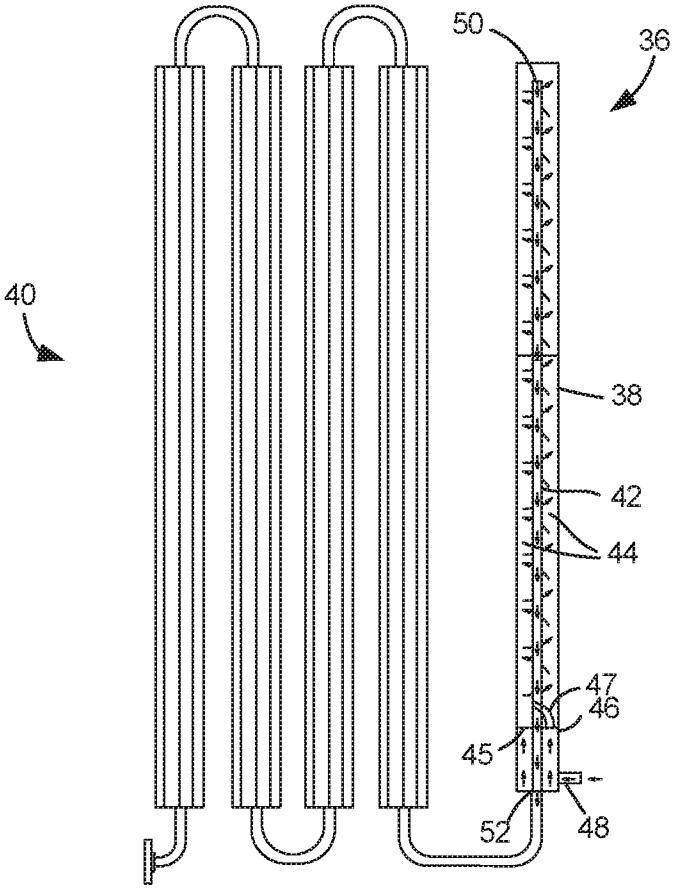
FIG. 5A shows a side view of a further embodiment of the invention which uses the ambient temperature.

Referring to FIG. 5A there is shown a further embodiment of a vaporizer (36) that has a tube (38) connected to a heat exchange unit (40). The tube (38) has an inner core tube (42) and an annulus (44) surrounding the inner core tube (42). Near the bottom of the tube (36) is a fluid controller means or a fluid movement generator (46) which is a disc or base (45) having an upstanding portion (47) from the disc, which is a curved reducer, that has a reducing aperture from its connection to the disc or base to its open end. The base has an aperture in the middle which the inner tube (42) goes through. It is so shaped to generate a swirling motion within the fluid that comes through inlet (48), then through the generator (46) and more particularly through the upstanding curved portion and then upwardly through the annulus (44), so that the velocity of the two-phase mixture increases and this will force the liquid flow to the inside wall of the tube (38) and therefore maximize the HTC so that the fluid is efficiently converted into a gas. The liquid travels up the annulus (44) to the top (50) of the core tube (42), and then is forced down the inner tube (42) to exit at the outlet (52) and into the heat exchanger (40).

In FIG. 5B, a vaporizer (54) has an outlet (56) at the top of its tube (58). A fluid 30 movement generator (60) is located adjacent the bottom of the tube (58) to impart a motion to the fluid entering through inlet (62). It has the same effect on the fluid as in FIG. 5A and likely is more effective at moving the liquid to the inside wall of the tube (58) as there is more space within the interior of the tube. A generator (60) also has a base/disc (61) to which is connected to a hollow upstanding portion, shown as a reducing diameter portion (63) through which the fluid (two-phase flow) flows and is directed, by the curved shape of that reducing diameter portion (63), towards the inner surface or wall of tube (58). The swirl or motion generator (60) is angled and either concentric or eccentric with respect to the base (61). If there is an inner tube going through the base (61) then the generator is generally eccentrically located on the base (61). There can be more than one generator and more than one upstanding portion on each generator, depending on the rate of flow of the fluid. The angle at which the generator directs the fluid flow is at approximately 10 degrees to the horizontal plane, as seen by the arrows in FIG. 5B. The reducer or generator will increase the velocity of the fluid as it passes therethrough, but will cause very little pressure drop. The speed is increased to force momentum in order to achieve the swirl effect.

It has been noted that the swirl generation in the flow path that forces the liquid flow against the interior wall of the tube (38) or (58), removes the blanketing effect alluded to in the background of the invention part of the description. This is one of the features that aids in reducing the Leidenfrost Effect.

Figure 6:
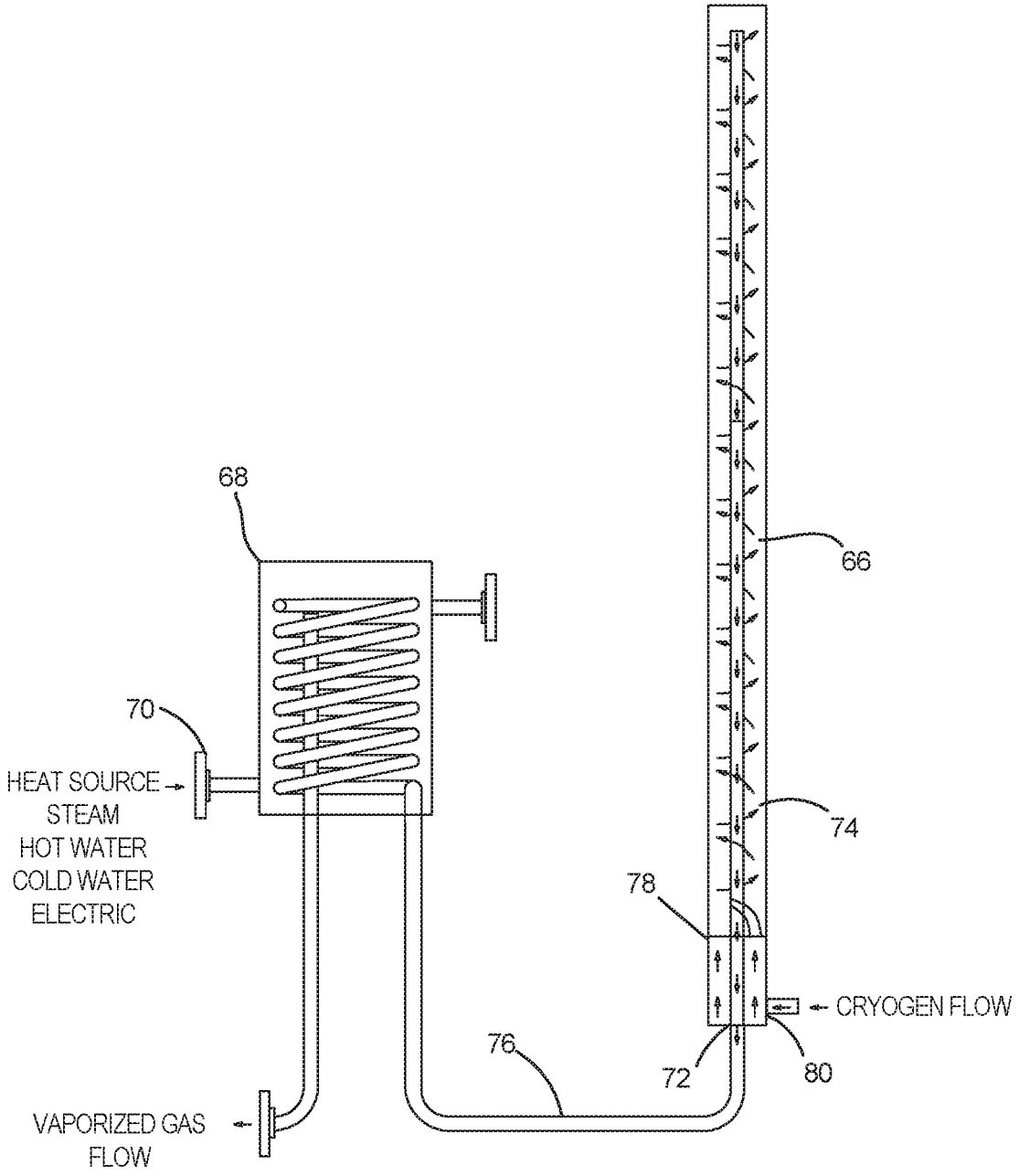
FIG. 6 shows a side view of the vaporizer where additional heating is provided to vaporize the fluid.

In FIG. 6, there is shown a further embodiment wherein tube (66) is connected to a heat exchange unit (68) which is heated by a heat source such as steam or hot water at inlet (70). An outlet (72) to the tube (66), and more particularly, an inner core tube (74), is connected to the heat exchange unit (68) through a separate tube (76). A fluid movement generator (78) is located at the bottom of the tube (66) near an input (80).

Figure 7B:
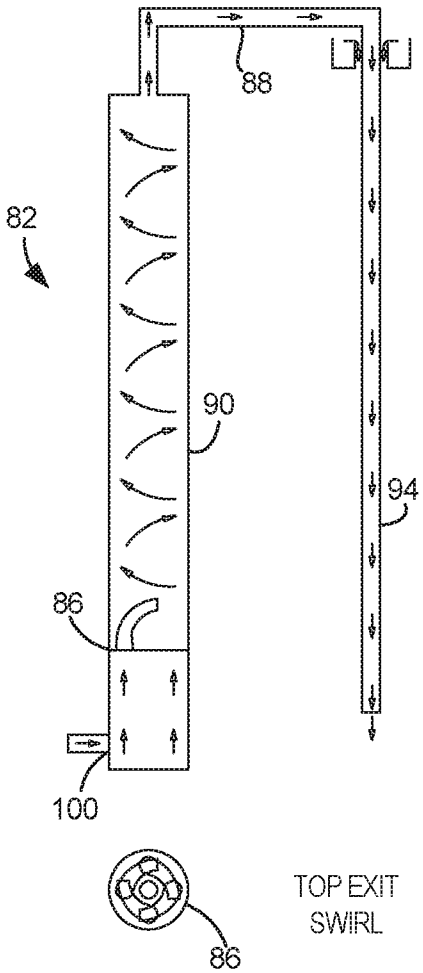
FIG. 7B shows a side view of a further embodiment of the vaporizer using a fluid motion generator.
Figure 7A:
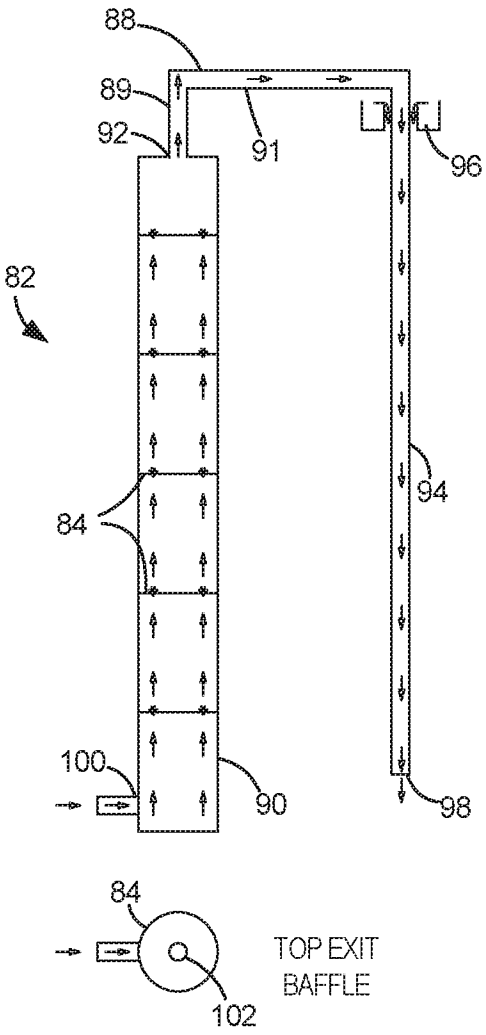
FIG. 7A shows a side view of a further embodiment of the vaporizer showing the use of plates.

In FIGS. 7A and 7B, there is shown an alternative vaporizer (82). However, FIG. 7B differs from FIG. 7A with the replacement of plates (84) in FIG. 7A by a fluid movement generator (86) in FIG. 7B. This arrangement is called an open rack vaporizer (82) in which an outlet tube (88) extends from the top of the tube (90) from its outlet at (92) and has three portions to the outlet pipe (88), being a riser tube (89), a horizontal tube (91) and a down tube (94). The down tube (94) has water flowing either side from a unit (96) as the heated gas expels from outlet (98). In FIG. 7A, initially cryogen liquid is input at inlet (100) and moves upwardly through a series of plates or baffles (84) that have a single aperture (102) in the middle of each plate (84), which liquid then slowly vaporizes on its path to the outlet (98). In FIG. 7B, the only difference from FIG. 7A is the inclusion of the fluid movement generator (86) which is more clearly shown in the plan view and is termed a top exit quad swirl, with four upstanding portions.

Figure 8B:
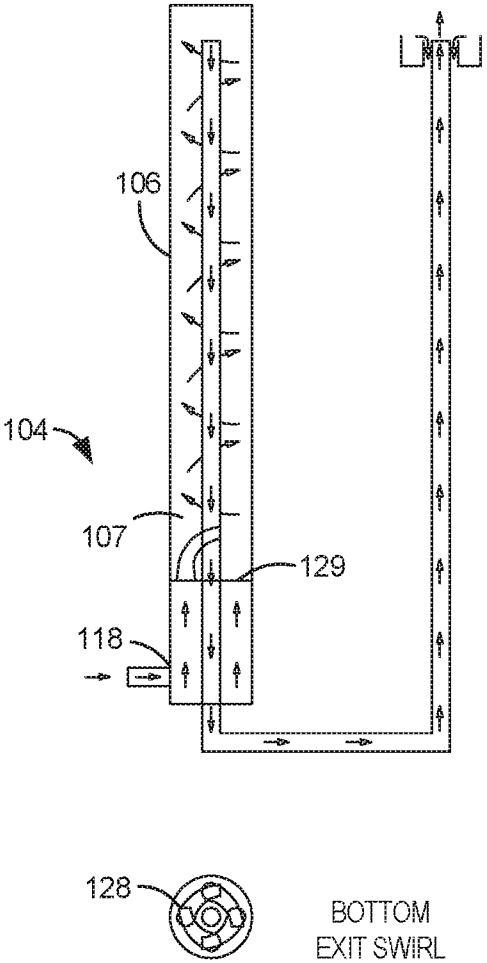
FIG. 8B shows a side view of a further embodiment of the vaporizer having an exit at the top thereof and using a fluid motion generator.
Figure 8A:
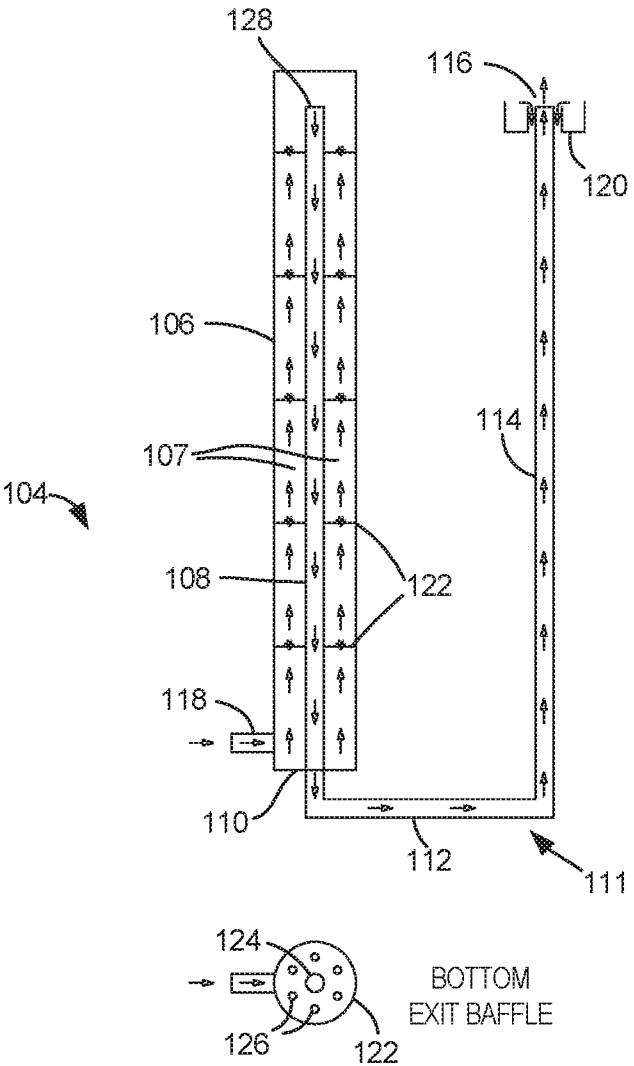
FIG. 8A shows a side view of a further embodiment of a vaporizer having an exit at the top thereof and showing plates located in the tube.

Referring to FIGS. 8A and 8B, there is shown an alternate vaporizer arrangement (104) which again is an open rack vaporizer unit where a tube (106) has a central inner tube (108) from which the fluid exits at an outlet (110) and goes through a horizontal portion (112) of an outlet pipe (111) and then vertically upwards through an upward portion (114) of that pipe (111) and out through exit (116). The liquid is input at inlet (118). Water flows down the outside of the vertical portion (114) from a unit (120). The only difference between the two figures is that, in FIG. 8A, there is a series of plates (122) spaced at predetermined positions that each have a central aperture (124) that surrounds the inner tube (108) and a series of smaller apertures (126) through which the fluid flows. Initially the fluid in FIG. 8A flows upwardly in an annular part (107) of the tube (106) until it reaches the top of the inner tube (108) at (128) and then flows downwardly inside tube (108) to the outlet (110). In FIG. 8B, instead of plates being used, there is a fluid movement generator (129) located in the bottom part of the tube (106) to circulate and move the fluid as it enters the inlet (118) in the annular part (107) of tube (106). The particular generator (129) is a quad swirl with a bottom exit.

Figure 9C:
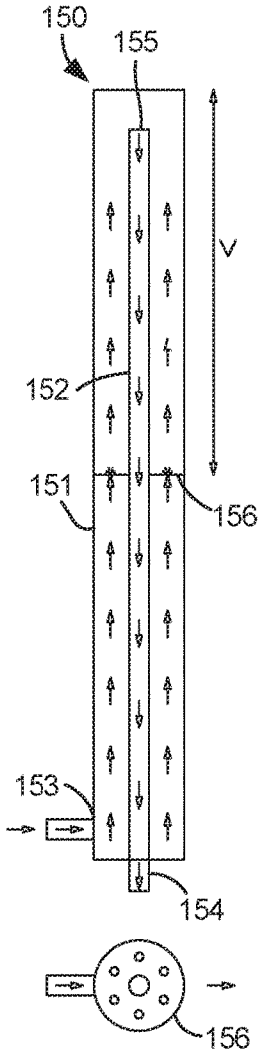
FIG. 9C is a side view of a further embodiment of a vaporizer having a single baffle located within the tube and having a bottom exit.
Figure 9B:
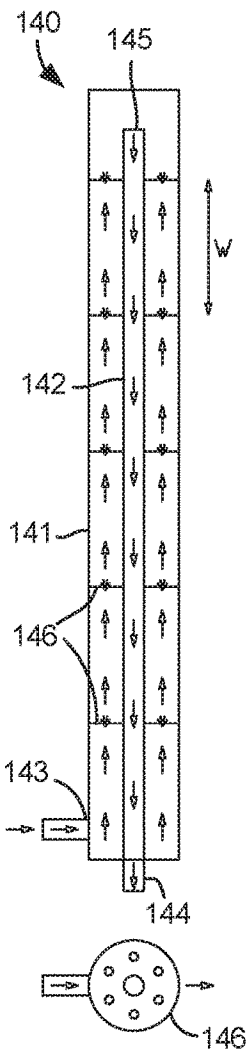
FIG. 9B is a side view of a further embodiment of a vaporizer having several baffles located within the tube and having a bottom exit.
Figure 9A:
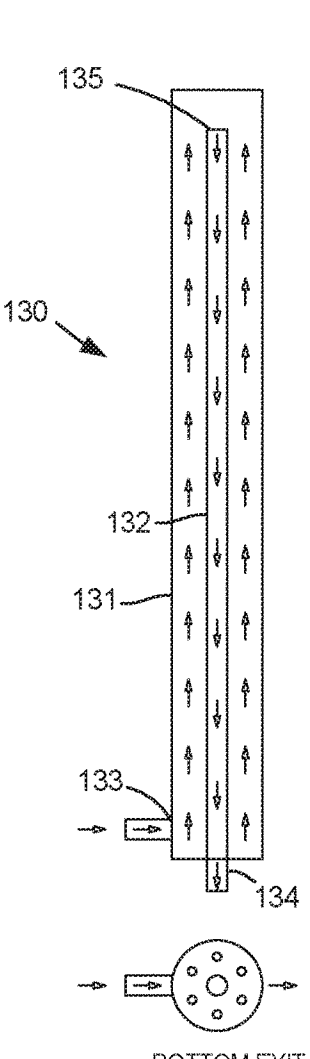
FIG. 9A is a side view of one embodiment of a vaporizer having a bottom exit.
Figure 9E:
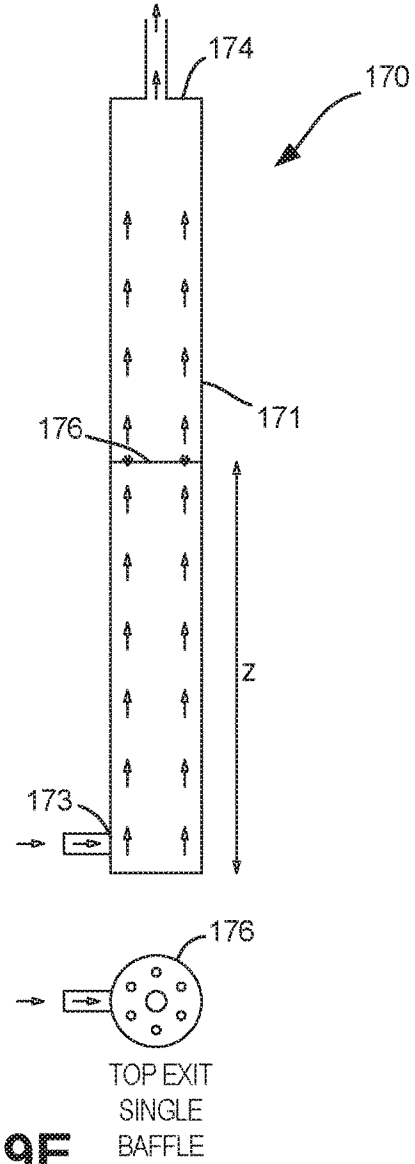
FIG. 9E is a side view of a further embodiment of a vaporizer having a single baffle located within the tube and having a top exit.
Figure 9D:
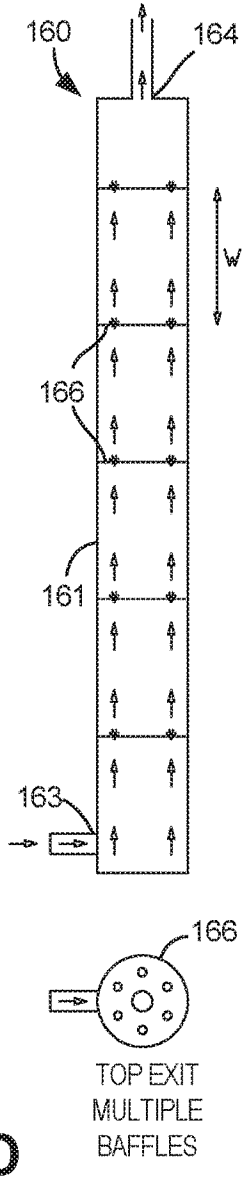
FIG. 9D is a side view of a further embodiment of a vaporizer having several baffles located within the tube and having a top exit.

Referring to FIGS. 9A-9E, there is shown a series of respective side and plan views of different embodiments of a vaporizer using either no plates or plates located at predefined spaces within the main tube of each vaporizer. In FIG. 9A, no plates are used in main tube (131). The liquid cryogen enters at a bottom inlet (133) and travels up an annulus part of tube (131) until it reaches a top (135) of an inner tube (132). There are no plates that slow the movement of the fluid in this particular arrangement, this is performed solely by the larger diameter of the main tube (131). The liquid or gas mixture then flows down the inner tube (132) and exits at outlet (134). In FIG. 9B, a vaporizer (140) includes a tube (141) that has an annulus surrounding an inner tube (142) and includes five plates or baffles (146) separated by a distance W. The plates (146) have a central aperture and six smaller holes through which the fluid flows. It is the same arrangement of the gas or fluid flow as in FIG. 9A where the fluid enters inlet (143) and travels upwardly through an annulus part and through the plates (146) until it reaches a top part (145) of the inner tube (142). The fluid then flows downwardly through the inner tube (142) and out of outlet (144). In FIG. 9C, only one plate (156) is used that has a central aperture with six small holes around the central aperture. The plate (156) is located midway in a tube (151) a distance V from each end thereof. Again, the fluid travels through inlet (153) and goes upwardly through an annulus of the tube (151) through the plate (156) until it reaches a top portion (155) of an inner tube (152). It then travels downwardly and out of outlet (154). In the arrangement of FIG. 9D, a vaporizer (160) does not have an inner tube but just has a main tube (161) and five plates (166) each separated by distance W. The plates (166) have a similar arrangement of apertures as plate (146). The cryogen liquid travels through inlet (163), then upwardly through a tube (161) and through the plates (166) to exit at outlet (164) at the top of the tube (161). Lastly in FIG. 9E, the vaporizer (170) has a main tube (171) which has a central plate (176) located at the middle of the tube (171) a distance Z from the top and bottom ends. Again the plate (176) has the same arrangement of apertures as plates (166, 156, and 146). The liquid to be vaporized enters at inlet (173) and travels upwardly through the plate (176) and out through outlet (174).

As seen in FIGS. 9A-9E generally, FIGS. 9A to 9C have an outlet and inlet at the bottom of the main tube, while in FIGS. 9D to 9E, the inlet is located at the bottom of the main tube and the outlet is located at the top of the main tube. By way of comparison, ad referring to FIGS. 10A-10F, there is a series, from FIGS. 10A to 10F, of different embodiments of a vaporizer having a fluid motion generator located at the bottom of the main tube.

As seen in FIG. 9 generally, FIGS. 9A to 9C have an outlet and inlet at the bottom of the main tube, while in FIGS. 9D to 9F, the inlet is located at the bottom of the main tube and the outlet is located at the top of the main tube. By way of comparison, ad referring to FIG. 10, there is a series, from FIGS. 10A to 10F, of different embodiments of a vaporizer having a fluid motion generator located at the bottom of the main tube.

Figure 10C:
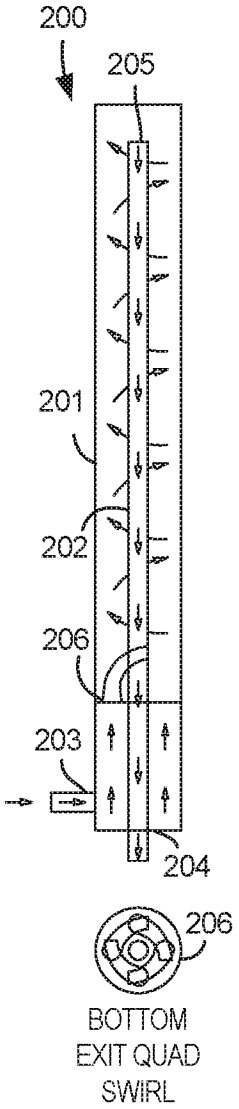
FIG. 10C is a side view of a further embodiment of a vaporizer having a fluid motion generator in the lower part of the tube and a bottom exit.
Figure 10B:
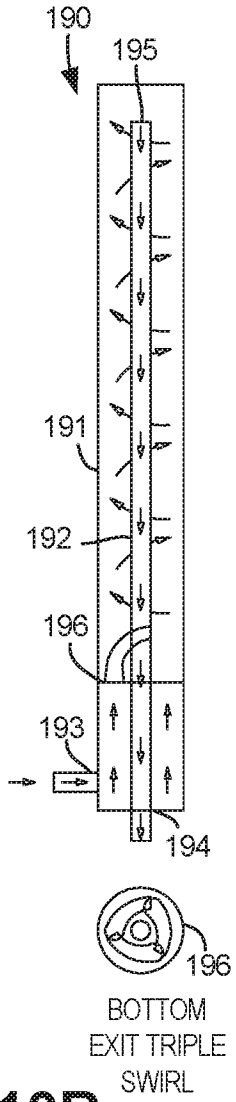
FIG. 10B is a side view of a further embodiment of a vaporizer having a fluid motion generator in the lower part of the tube and a bottom exit.
Figure 10A:
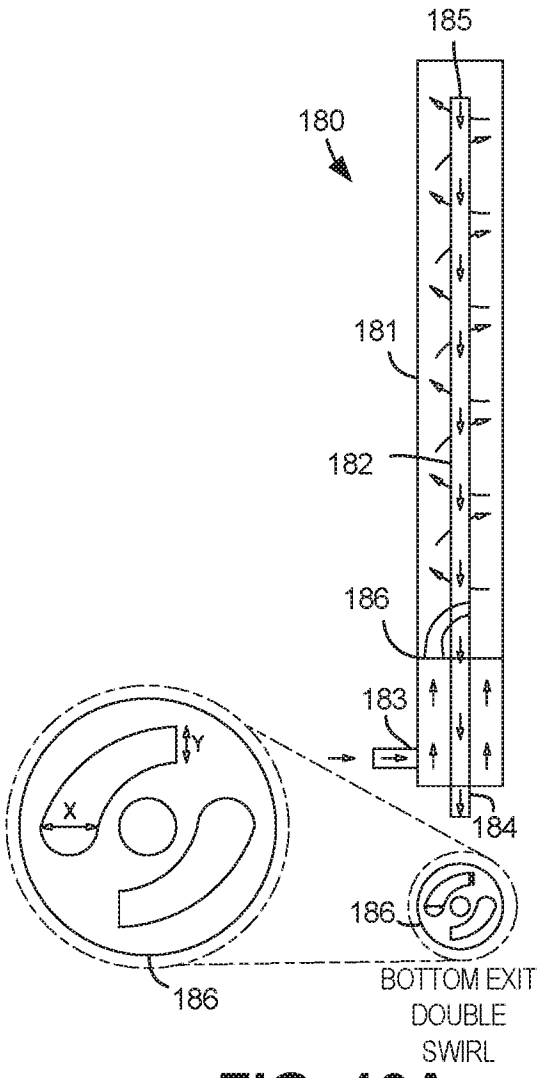
FIG. 10A is a side view of an embodiment of a vaporizer with a fluid motion generator located in the lower part of the tube and with a bottom exit.

Referring to FIGS. 10A to 10C, they each depict respectively, vaporizers (180, 190, 200). Each has a main tube (181, 191, 201) with an inner tube (182, 192, 202). An inlet (183, 193, 203) is respectively located at the bottom as are outlets (184, 194, 204). At the bottom, or located near the bottom, of each of the respective tubes is a fluid motion generator (183, 196, 206). In the embodiment of vaporizer (180), the generator (186) is a disc or plate that has two curved upstanding portions around a central aperture through which the inner tube (182) protrudes. In this example, the generator (186) can be referred to as a double swirl generator. In FIG. 10B, the generator (196) is a triple swirl generator having three curved upstanding portions located around a central hole through which the inner tube (192) extends. In FIG. 10C, the generator (206) is a quad swirl having four curved upstanding portions to pass the fluid formed around a central hole through which the inner tube (202) extends. In all of these embodiments (FIGS. 10A to 10C), fluid arrives at the inlet at the bottom of the respective tube and travels upwardly until it respectively arrives at the top (185, 195, 205) of the inner tubes (182, 192, 202). From there, it travels downwardly through the inner tube and out of the respective outlet (184, 194, 204) at the bottom of the respective inner tube.

Figure 10F:
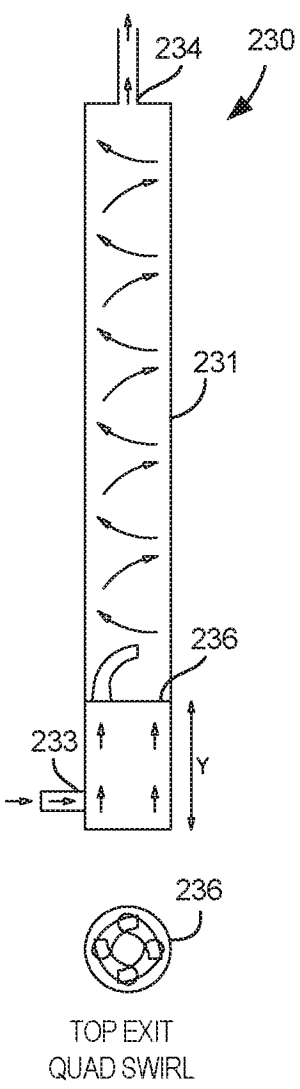
FIG. 10F is a side view of a further embodiment of a vaporizer having a fluid motion generator in the lower part of the tube and a top exit.
Figure 10E:
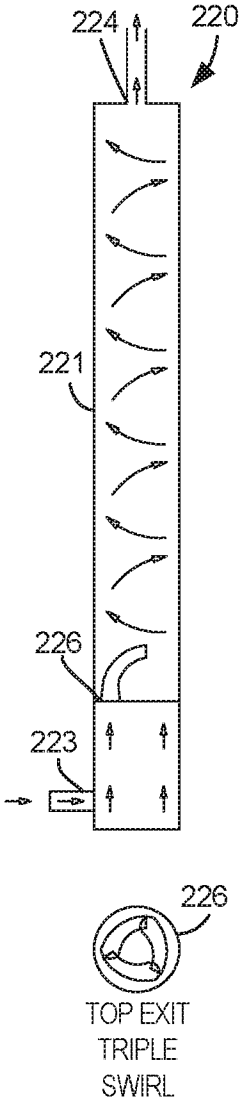
FIG. 10E is a side view of a further embodiment of a vaporizer having a fluid motion generator in the lower part of the tube and a top exit.
Figure 10D:
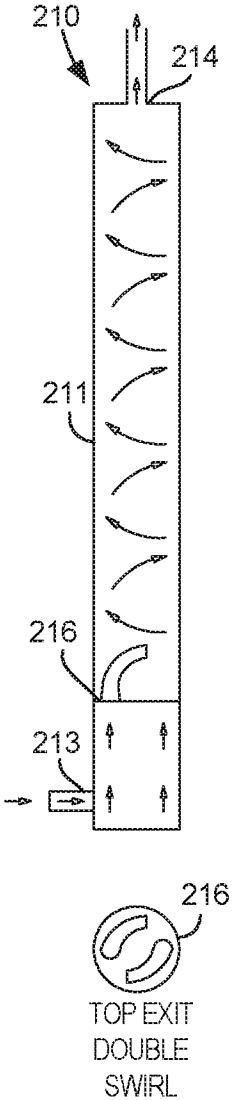
FIG. 10D is a side view of a further embodiment of a vaporizer having a fluid motion generator in the lower part of the tube and a top exit.

Referring to FIGS. 10D, 10E, and 10F, they show a vaporizer (210,220, 230) that each have a main tube (211, 221, 231). There is no inner tube located inside the main tubes. An inlet exists at the bottom being designated by (213,223, 233) respectively and an outlet is at the top of each tube being (214, 224, 234). Located near bottom of each main tube is a fluid motion generator (216, 226, 236 respectively). Fluid to be vaporized is applied at the inlet at the bottom of each main tube which travels upwardly through the respective fluid motion generator and then out through the outlet at the top of each of the main tubes. The fluid motion generator (216) has two upstanding portions that are curved in shape and eccentrically located. The generator (226) has three upstanding reducing diameter portions, termed a triple swirl, and generator (236) is a quad swirl having four separate upstanding portions through which the fluid flows. In all of the generators disclosed in FIGS. 10A to 10F, fluid travels through these generators and their effect on the fluid is to force liquid to the inside wall of each of the main tubes and therefore maximize the heat transfer coefficient.

Figure 11A:
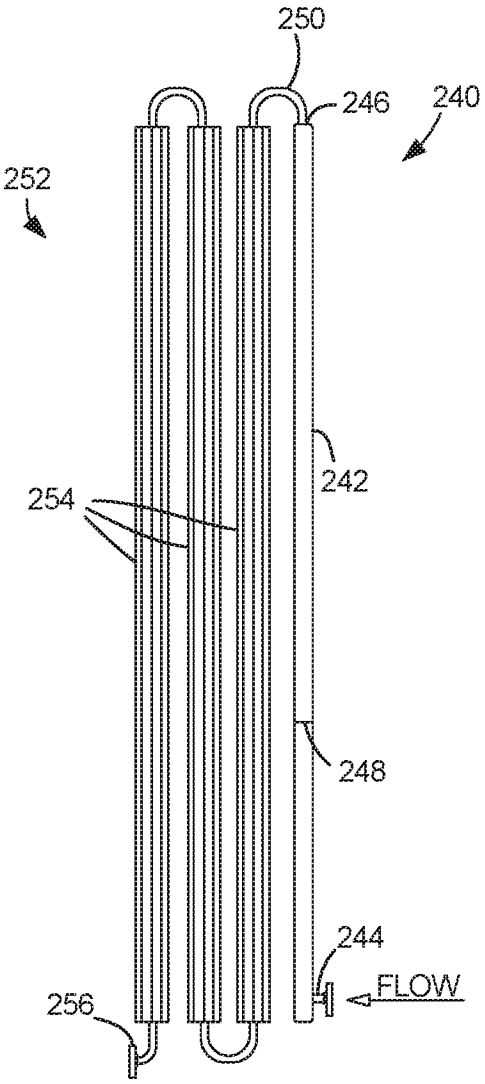
FIG. 11A shows an alternative arrangement of the vaporizer according to another embodiment.

With reference to FIG. 11A, there is shown a further embodiment where a vaporizer (240) has a main tube (242) having an inlet (244), an outlet (246), and a plate (248) having a series of apertures therein. The outlet (246) is joined through a segment of pipe (250) to a heat exchanger apparatus (252) that includes three vertical sections of tubing (254) all joined one to the other and having an outlet at (256). Cryogenic fluid flows through the inlet (244) and upwardly through the plate (248) of the main tube (242) where it starts to vaporize into a gas and then is forced to move into the first upright portion (254) of the heat exchange unit (252).

Figure 11B:
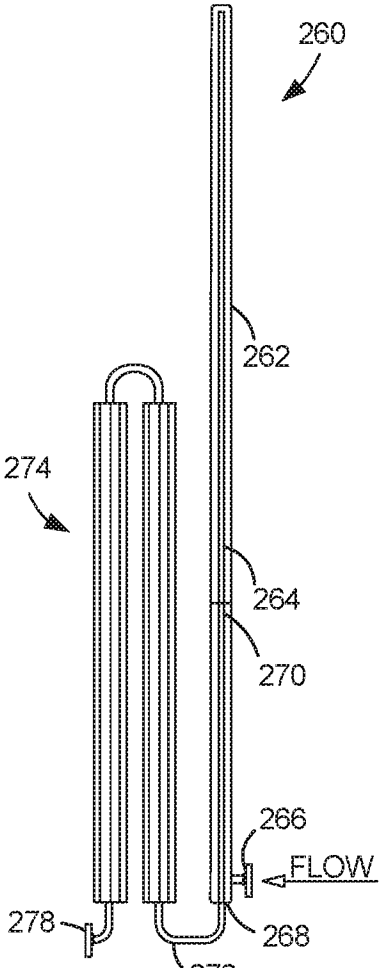
FIG. 11B shows a second alternative arrangement of the vaporizer according to another embodiment.

In FIG. 11B there is shown a further embodiment of a vaporizer (260) which has a main tube (262), an inner tube (264), an inlet (266), an outlet (268), and a single plate (270). It is connected through piping (272) to a heat exchange unit (274) that has a pair of upright portions of tubes (276) and a further outlet (278). The motion of cryogenic fluid changing from the liquid phase to the gas phase is similar to that described in relation to FIGS. 3, 4A, and 4C.

Figure 11C:
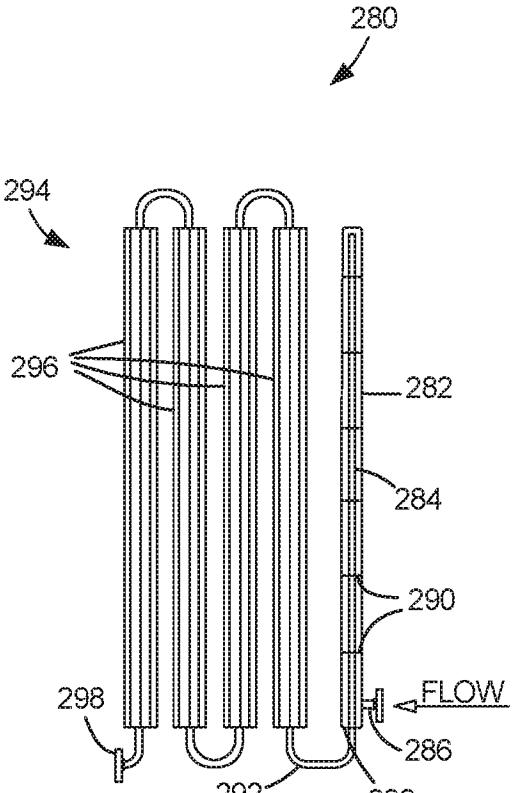
FIG. 11C shows a third alternative arrangement of the vaporizer according to another embodiment.

Shown in FIG. 11C is a further embodiment of a vaporizer (280) having a main tube (282), an inner tube (284), an inlet (286), an outlet (288), and a series of spaced apart plates (290). This is connected through a tubing arrangement (292) to heat exchange unit (294) that includes four vertical sections of piping (296) and an outlet (298). Again the flow of cryogenic fluid from the liquid phase to gas phase is similar to that described in FIGS. 3, 4A, and 4C.

Figure 12:
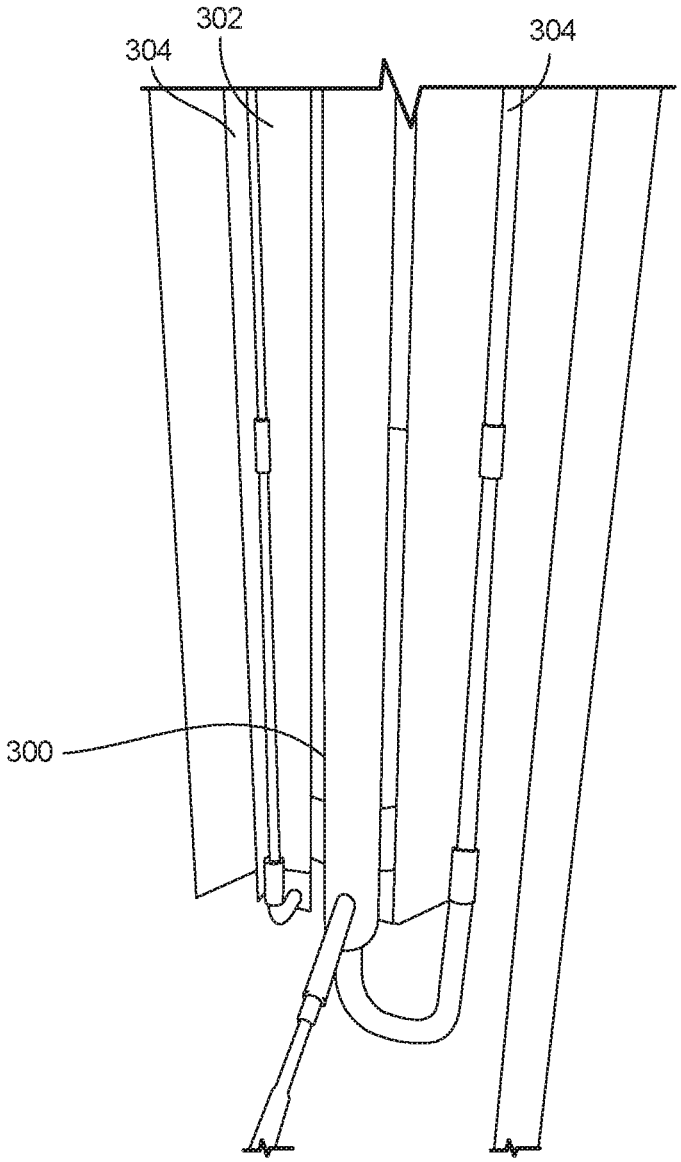
FIG. 12 is a photograph showing the tube of the vaporizer, the inlet and the outlet being frosted over while the heat exchanger it is attached to is not frosted over.

Finally, in relation to FIG. 12, example advantages of the present invention are illustrated. In particular, FIG. 12 illustrates a main pipe or tube (300) that is connected to a heat exchange unit (302) in a similar fashion to that described in FIGS. 11A to 11C. As can be seen, the main tube (300) is frosted up through the heat transfer between the inside of the main pipe and the external ambient atmosphere. Notably, there is no frosting up shown on the heat exchanger (302) or any of the fins (304) of the heat exchanger.

Figure 13:
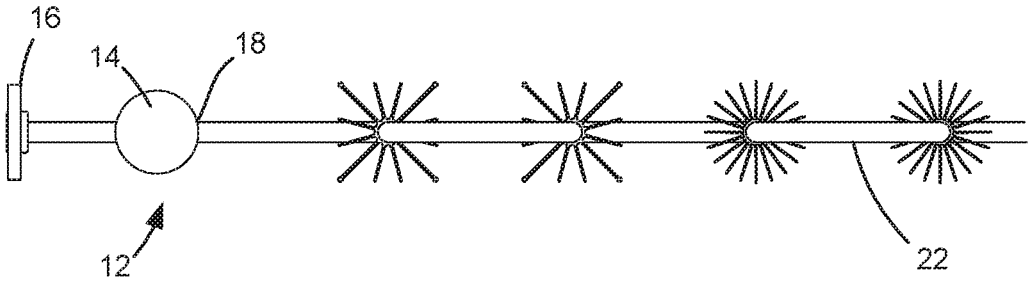
FIG. 13 is a top schematic view of an embodiment of the cryogenic vaporizer shown in FIG. 2.
Figure 14:
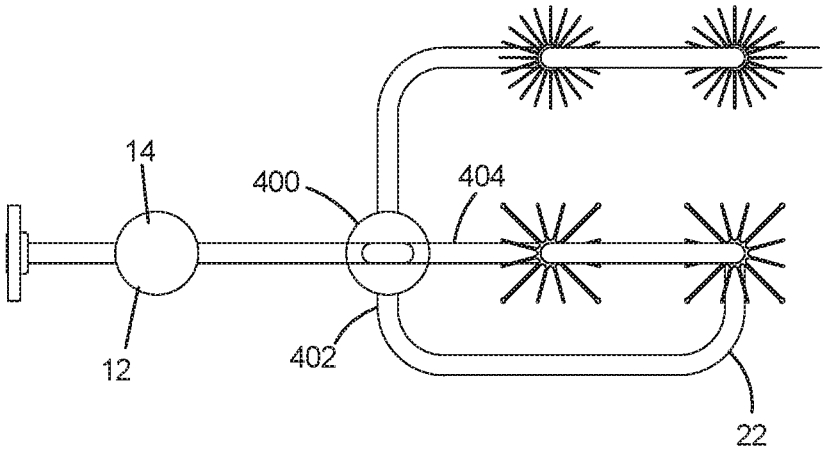
FIG. 14 shows one alternative embodiment of the cryogenic vaporizer having a feedback loop to optimize heat transfer.

Additional features may be added to the above-described embodiments. FIG. 13 shows a top schematic view of a cryogenic vaporizer (12) as shown in FIG. 2. This embodiment may be ideally suited for a flowrate of 200 to 4,000 $Nm^3$/hr. For a higher flowrate, an alternative embodiment may be employed, as illustrated in the top schematic view shown in FIG. 14, which represents an alternative configuration of such a cryogenic vaporizer, and which is applicable to any of the cryogenic vaporizer designs illustrated in FIGS. 2-12. In particular, an outlet (18) of the vaporizer tube (14) may be routed to a tube-side of a separate shell-and-tube (e.g., tube-in-tube) heat exchanger (400). Such a heat exchanger (400) will generally be located "downstream" of the vaporizer tube (14), e.g., after the outlet (18). A tube-side outlet (404) of this heat exchanger operates as a feedback loop and is routed to the inlet at its own shell side. This shell-side inlet (402) has a diameter that is larger than the tube-side outlet diameter in order to minimize the potential increase in fluid velocity and thereby minimize ice formation. The fluid stream on the shell side of the shell-and-tube heat exchanger exchanges heat with the fluid stream passing through the tube side of the shell-and-tube heat exchanger (400). Passing the fluid through a first vaporizer, such as vaporizer (12), ensures that fluid in the gaseous phase enters the shell-and-tube heat exchanger tube-side inlet and minimizes two-phase flow. This heat integration configuration provides for enhanced heat recovery and promotes heat exchange efficiency. The resulting temperature differential for the shell-and-tube heat exchanger will be in the range of about 40 to 50 degrees. The shell-side gas exit temperature will be closer to ambient temperature than that of a conventional configuration. Such conditions are ideal to maximize heat transfer efficiency and will result only in minimal ice formation and no clogging in the vaporizer tubes.

The benefits of the alternative embodiment are readily observable when comparing heat exchange performance with a conventional ambient vaporizer, and these benefits are best observed at a flow rate of 3,000 to 50,000 $Nm^3$/hr. The alternative embodiment of FIG. 14 results in a higher degree of heat transfer efficiency at a reduced materials cost. In another embodiment, multiple cryogenic vaporizers are connected in series. The feedback loop must always be implemented downstream of at least one cryogenic vaporizer.

In still further embodiments, other types of enhanced operational features may be incorporated into the cryogenic vaporizers disclosed herein. For example, in some embodiments, a forced-air feature can be included, in which forced air is introduced to ambient portions of the cryogenic vaporizer designs of FIGS. 1-14. This involves, for example, arranging a fan or other forced-air system to pass air along the exposed tubes, such as the vaporizer tube (14), the heat exchanger (22), and/or the shell-and-tube heat exchanger (400). Any of a variety of forced air systems may be used, only one example of which is a fan-forced air system.

Referring to FIGS. 1-14 overall, it is noted that the present invention provides a number of advantages relative to existing cryogenic vaporizer designs. For example, the present invention improves the heat transfer coefficient between the liquid to be vaporized and the wall of the main tube of the vaporizer. It reduces the raw material costs of making a heat exchanger or vaporizer by up to 45% and reduces labor costs by about a third. The present invention will not clog with ice or snow and smaller extrusions can be used on the "gas side" as there will be no clogging. Different combinations of heat exchangers can be utilized for warming the gas, expelled by this system, in the last 30-40° C. that can be even more economical than aluminum extrusions.

While the disclosure has been described in detail with reference to the specific embodiments thereof, these are merely examples, and various changes, arrangements and modifications may be applied therein without departing from the spirit and scope of the disclosure.

The invention claimed is:

1. A liquid cryogenic vaporizer including:

a main tube;

a cryogenic fluid inlet positioned proximate a first end of the main tube for receiving cryogenic fluid;

a second tube having a diameter smaller than the main tube, the second tube being in fluid communication with the main tube at a second end of the main tube opposite the cryogenic fluid inlet;

an outlet extending from the second tube for expelling vaporized fluid; and one or more plates located in the main tube, the one or more plates having at least one aperture for the cryogenic fluid to flow through, the one or more plates acting to create turbulence to mix a vapor phase of the cryogenic fluid and a liquid phase of the cryogenic fluid together to assist in making the cryogenic fluid contact one or more surfaces of the main tube;

wherein velocity of the flow of the cryogenic fluid in the main tube is controlled to increase heat transfer between the cryogenic fluid and the one or more surfaces within the main tube.

2. The liquid cryogenic vaporizer of claim 1, wherein the second tube is positioned within the main tube.

3. The liquid cryogenic vaporizer of claim 2, further comprising a heat exchange unit fluidically connected to the outlet.

4. The liquid cryogenic vaporizer of claim 3, wherein the heat exchange unit includes a counterflow tube-in-tube heat exchanger and a second heat exchanger having an inlet connected to the outlet and an outlet tube forming a gas feedback path to the counterflow tube-in-tube heat exchanger.

5. The liquid cryogenic vaporizer according to claim 1, wherein the main tube is dimensioned to reduce the velocity of the flow of the cryogenic fluid.

6. The liquid cryogenic vaporizer according to claim 5, wherein the second tube includes an inlet to receive cryogenic fluid, and wherein the second tube is located within the main tube such that a space is formed between an inner surface of the main tube and an outer surface of the second tube.

7. The liquid cryogenic vaporizer according to claim 6, wherein the cryogenic fluid is vaporized upon leaving the outlet of the second tube, and the vaporized fluid is expelled within the main tube and acts as the heat transfer fluid to the cryogenic fluid remaining in the second tube, the expelled vaporized fluid eventually being expelled from the main tube.

8. The liquid cryogenic vaporizer according to claim 1, wherein the outlet is routed to a heat exchanger having a first inlet and a first outlet and a second inlet and a second outlet, wherein the cryogenic fluid from the outlet enters the first inlet of the heat exchanger and exchanges heat with the cryogenic fluid from the first outlet of the heat exchanger, and the cryogenic fluid from the first outlet of the heat exchanger travels through the second inlet of the heat exchanger and exits through the second outlet of the heat exchanger.

9. A method of vaporizing the cryogenic fluid using the liquid cryogenic vaporizer of claim 1 including:

receiving cryogenic fluid at the cryogenic fluid inlet to travel through the main tube;

expelling vaporized liquid from the outlet; and controlling the velocity of the flow of the cryogenic fluid through the main tube to increase heat transfer between the cryogenic fluid and the one or more surfaces within the main tube.

10. The method of vaporizing the cryogenic liquid according to claim 9, where the second tube is located within the main tube such that a space is formed between an inner surface of the main tube and an outer surface of the second tube.

11. The method of vaporizing the cryogenic liquid according to claim 9, wherein the second tube has an inlet to receive the cryogenic liquid to flow into the second tube.

12. The method of vaporizing the cryogenic liquid according to claim 11, wherein the cryogenic fluid is vaporized upon leaving an outlet of the second tube, the expelled vaporized fluid is expelled within the main tube and acts as the heat transfer to the cryogenic fluid remaining in the second tube, and the expelled vaporized fluid is eventually expelled from the main tube.

13. The liquid cryogenic vaporizer of claim 1, wherein at least one of the one or more plates has a central aperture and auxiliary apertures positioned around the central aperture, the auxiliary apertures each being smaller than the central aperture.

14. The liquid cryogenic vaporizer of claim 13, wherein the at least one of the one or more plates includes at least six auxiliary apertures.

* * * * *